US007971404B2

(12) United States Patent
Timko et al.

(10) Patent No.: US 7,971,404 B2
(45) Date of Patent: Jul. 5, 2011

(54) SYSTEMS AND METHODS FOR INSTALLING PANELS

(75) Inventors: William J. Timko, Suwanee, GA (US); Mark Brinkman, Gainesville, GA (US)

(73) Assignee: Fry Reglet Corporation, Alhambra, CA (US)

( * ) Notice: Subject to any disclaimer, the term of this patent is extended or adjusted under 35 U.S.C. 154(b) by 630 days.

(21) Appl. No.: 11/392,044

(22) Filed: Mar. 29, 2006

(65) Prior Publication Data

US 2006/0272277 A1 Dec. 7, 2006

Related U.S. Application Data

(60) Provisional application No. 60/669,757, filed on Apr. 8, 2005.

(51) Int. Cl.
*E04F 13/09* (2006.01)

(52) U.S. Cl. ..... 52/511; 52/476; 52/775; 52/780; 403/291; 403/387

(58) Field of Classification Search ..... 52/474, 52/475.1, 476, 483.1, 489.1, 489.2, 763, 52/764, 777, 778, 779, 506.01, 506.05, 506.06, 52/506.08, 511, 512, 222, 235, 716.7, 208, 52/587, 775, 780; 403/327, 291, 387; 411/508–510
See application file for complete search history.

(56) References Cited

U.S. PATENT DOCUMENTS

| | | | | | |
|---|---|---|---|---|---|
| 1,760,265 | A * | 5/1930 | Carr | 52/511 |
| 1,805,334 | A * | 5/1931 | Kelly | 52/434 |
| 1,896,875 | A * | 2/1933 | Walters | 52/511 |
| 2,059,483 | A * | 11/1936 | Parsons | 52/506.06 |
| 2,337,239 | A * | 12/1943 | Hall | 52/511 |
| 2,403,881 | A * | 7/1946 | Tarbox | 52/506.08 |
| 3,491,486 | A * | 1/1970 | Caruth | 49/463 |
| 3,832,820 | A * | 9/1974 | Eggert | 52/506.08 |
| 3,969,865 | A * | 7/1976 | Andersen | 52/506.07 |
| 5,056,287 | A * | 10/1991 | Weber | 52/511 |
| 5,123,225 | A * | 6/1992 | Goodworth | 52/506.08 |
| 5,653,076 | A * | 8/1997 | Habraken et al. | 52/481.2 |
| 5,692,345 | A * | 12/1997 | Mogaki et al. | 52/483.1 |
| 5,716,161 | A * | 2/1998 | Moore et al. | 403/326 |
| 5,845,447 | A * | 12/1998 | Bodine et al. | 52/506.09 |
| 6,170,214 | B1 * | 1/2001 | Treister et al. | 52/511 |
| 6,364,404 | B1 * | 4/2002 | De Paoli | 296/201 |
| 6,510,635 | B1 * | 1/2003 | Rudolph et al. | 40/658 |
| 6,588,165 | B1 * | 7/2003 | Wright | 52/506.05 |
| 6,968,661 | B2 * | 11/2005 | Kopish et al. | 52/489.1 |
| 7,107,732 | B2 * | 9/2006 | Kinzler | 52/404.5 |
| 7,210,273 | B2 * | 5/2007 | Zahner, III | 52/302.3 |
| 2006/0000177 | A1 * | 1/2006 | Salzano et al. | 52/474 |
| 2006/0179762 | A1 * | 8/2006 | Thome et al. | 52/506.01 |

* cited by examiner

*Primary Examiner* — Michael Safavi

(74) *Attorney, Agent, or Firm* — Kilpatrick Townsend & Stockton LLP

(57) ABSTRACT

Systems and methods for installing one or more modular panels onto a wall or other surface. Such systems may include at least one panel retainer mounted to a substantially vertical surface and at least one panel connected to the panel retainer in a removable fashion. In these systems, the interaction of at least one deformable body and at least one groove facilitates connecting the panel to the panel retainer in a removable fashion.

13 Claims, 18 Drawing Sheets

SYSTEMS AND METHODS FOR INSTALLING PANELS

RELATED APPLICATIONS

This document claims the benefit of the filing date of U.S. Provisional Application Ser. No. 60/669,757, filed Apr. 8, 2005 and entitled "System and Method for Installing Wall Covering Panels," the entire contents of which are hereby incorporated by this reference.

RELATED FIELDS

This invention relates to systems and methods for installing one or more panels onto a wall or another surface. More particularly, this invention relates to systems and methods for installing one or more modular panels onto a wall or other surface in a removable fashion.

BACKGROUND

Various wall covering systems are known in which a number of panels are installed onto a substrate to create a finished surface or other desired effects on the wall. Typically, installation of these panels occurs in a progressive manner. With progressive installation, the position of each panel is determined by the position of the previously installed adjacent panel and the adjacent panels are attached to one another. For example, a tongue extending from one edge of a panel can fit into a groove in an adjacent panel to lock the two panels together.

There are drawbacks associated with progressive installation. For example, once the panels are installed, it is relatively difficult to replace, rearrange or change the orientation of the panels. Since all of the panels are linked together, changing one panel may require many, if not all, of the panels to be removed and reinstalled.

SUMMARY

Unlike previous systems, the panel systems of the present invention are modular and may permit the removal and/or replacement of the panels without having to remove the adjacent panels.

In some embodiments, the system is a modular panel system that includes at least one panel retainer mounted to a substantially vertical surface and at least one panel connected to the panel retainer in a removable fashion. In this system, the interaction of at least one deformable body and at least one groove facilitates connecting the panel to the panel retainer in a removable fashion. In some embodiments, the deformable body is formed on an end of a substantially rigid tongue.

More particularly, this invention relates to mounting a framework of panel retainers onto a wall or other substrate and positioning the panels to engage at least a portion of the panel retainers. Through such engagements, the panel retainers retain the panels in the desired position as dictated by the framework.

In some embodiments, the modular panel system is installed by: selecting an area on a substantially vertical surface; mounting one or more panel retainers to the substantially vertical surface in or proximate the selected area; and connecting one or more panels to the mounted panel retainers in a removable fashion by inserting one or more deformable bodies into one or more grooves.

DETAILED DESCRIPTION OF THE DRAWINGS

Figure 1:
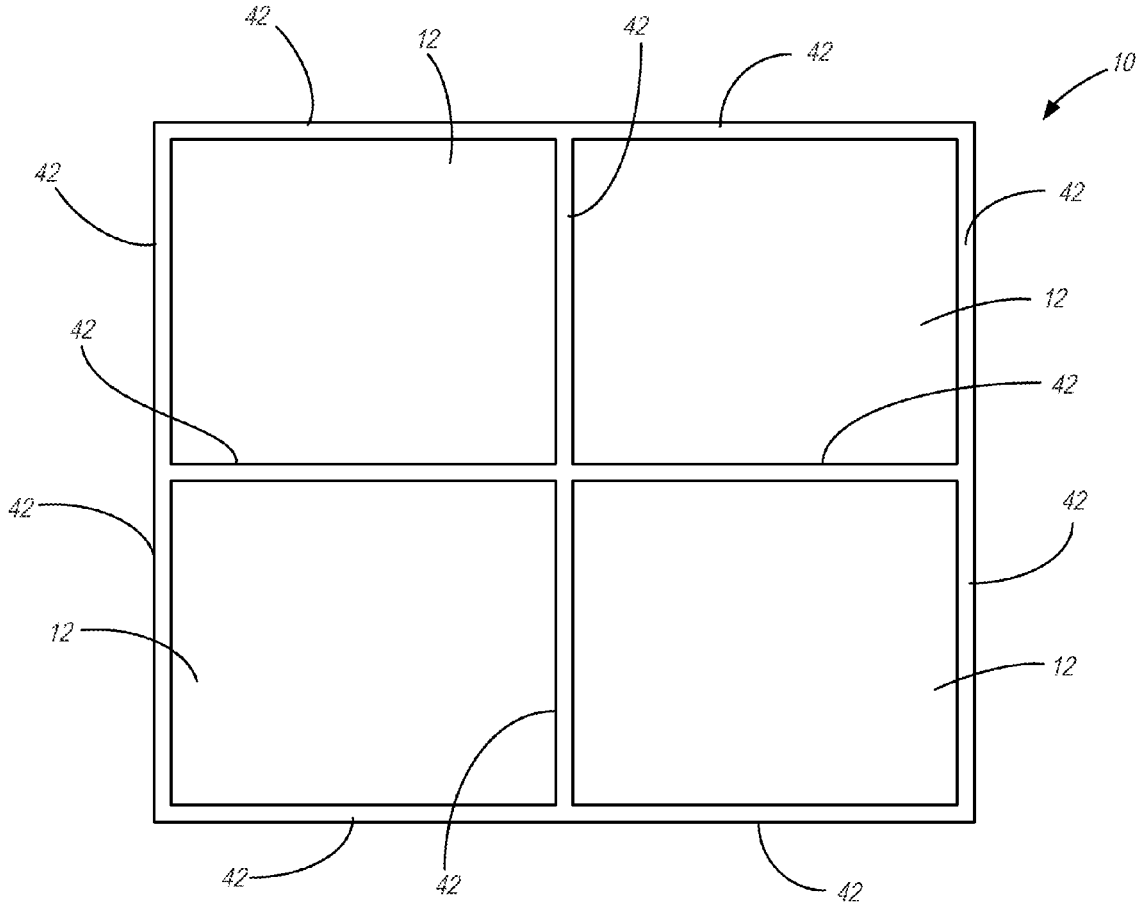
FIG. 1 schematically shows a modular panel system in accordance with embodiments of the present invention.

The Figures illustrate embodiments of modular panel systems 10 within the scope of the present invention. Using the modular panel systems 10 shown, an installer can secure one or more panels to a wall or other substrate in a modular and removable manner. Although not shown in the Figures, the front surfaces of the panels may include graphics or text (such as advertising, marketing, presentation or other media), or may simply have a plain or ornamental appearance (whether patterned, colored, textured or otherwise). Whether the panels include graphics, or simply have a plain or ornamental appearance, the panels may be finished using any conventional or non-conventional technique. For example, the panels may be primed, painted, printed, sealed, or treated in other manners to yield smooth or textured finishes for either indoor or outdoor applications. Using the modular panels, various shapes and sizes of wall coverings can be created.

The wall panels are preferably, but do not have to be, formed from a substrate (such as medium density fiberboard) onto which a finish (such as a textile (e.g., carpet, fabric, etc.), paint, paper, sealer etc.) is applied. Alternatively, wall panels 12 can be formed from other materials and in other manners. For example, wall panels 12 may be wood, wood veneer, glass, plastic, metal, concrete, or formed from other materials or combinations of materials. In some embodiments, wall panels 12 may include certain advantageous properties, such as acoustical, fire retardant, insulating, or other properties.

The systems 10 shown in the Figures generally include the panels 12, various types of panel retainers 14, 36, and 38, grooves 18, and deformable bodies 16. The deformable bodies 16 interact with and engage the grooves 18 to secure the panels 12 to the panel retainers. In the embodiments shown in the Figures, the grooves 18 are formed in the panel retainers and the deformable bodies 16 extend from rear surfaces of the panels 12. In other embodiments, however, panels 12 may include the grooves 18 and the panel retainers may include the deformable bodies 16.

Figure 2:
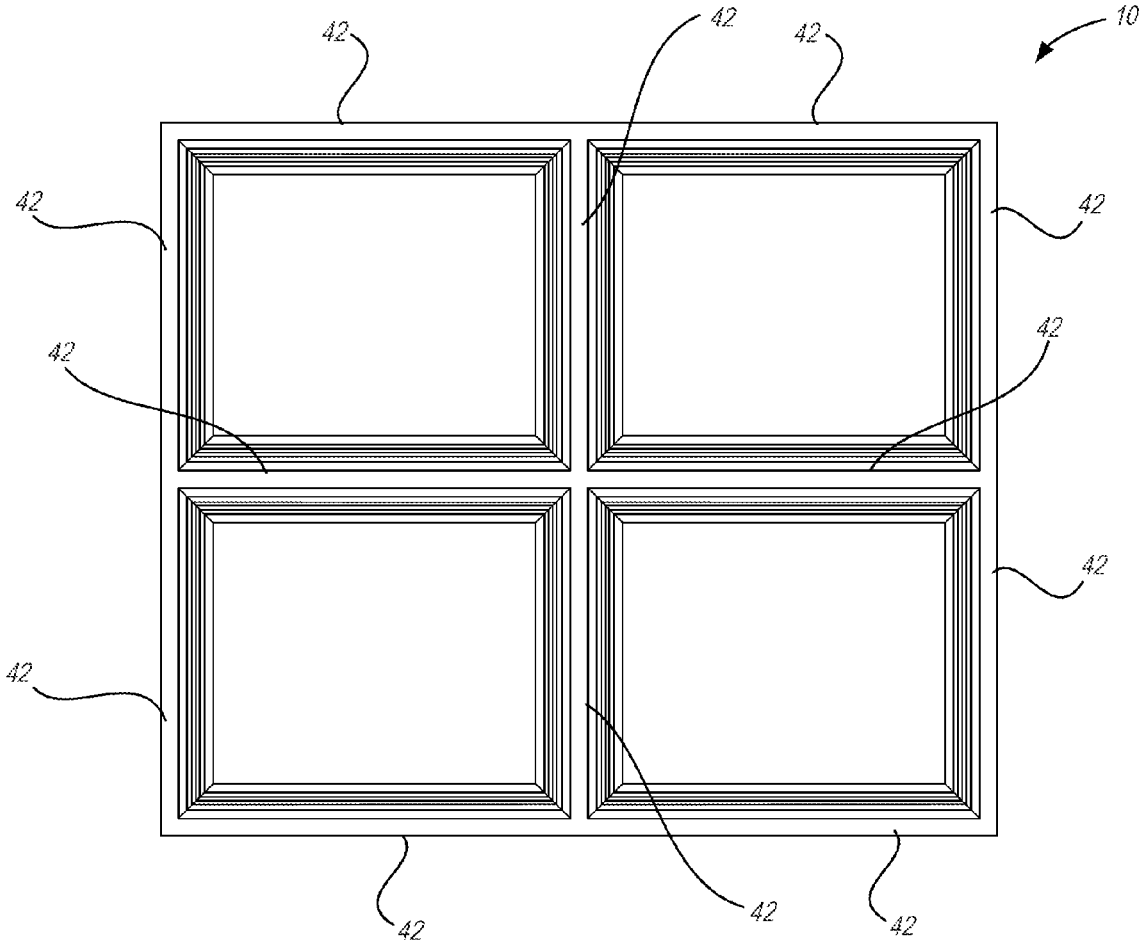
FIGS. 2 and 2*a* both schematically shows the modular panel system of FIG. 1 with the panels removed.
Figure 2A:
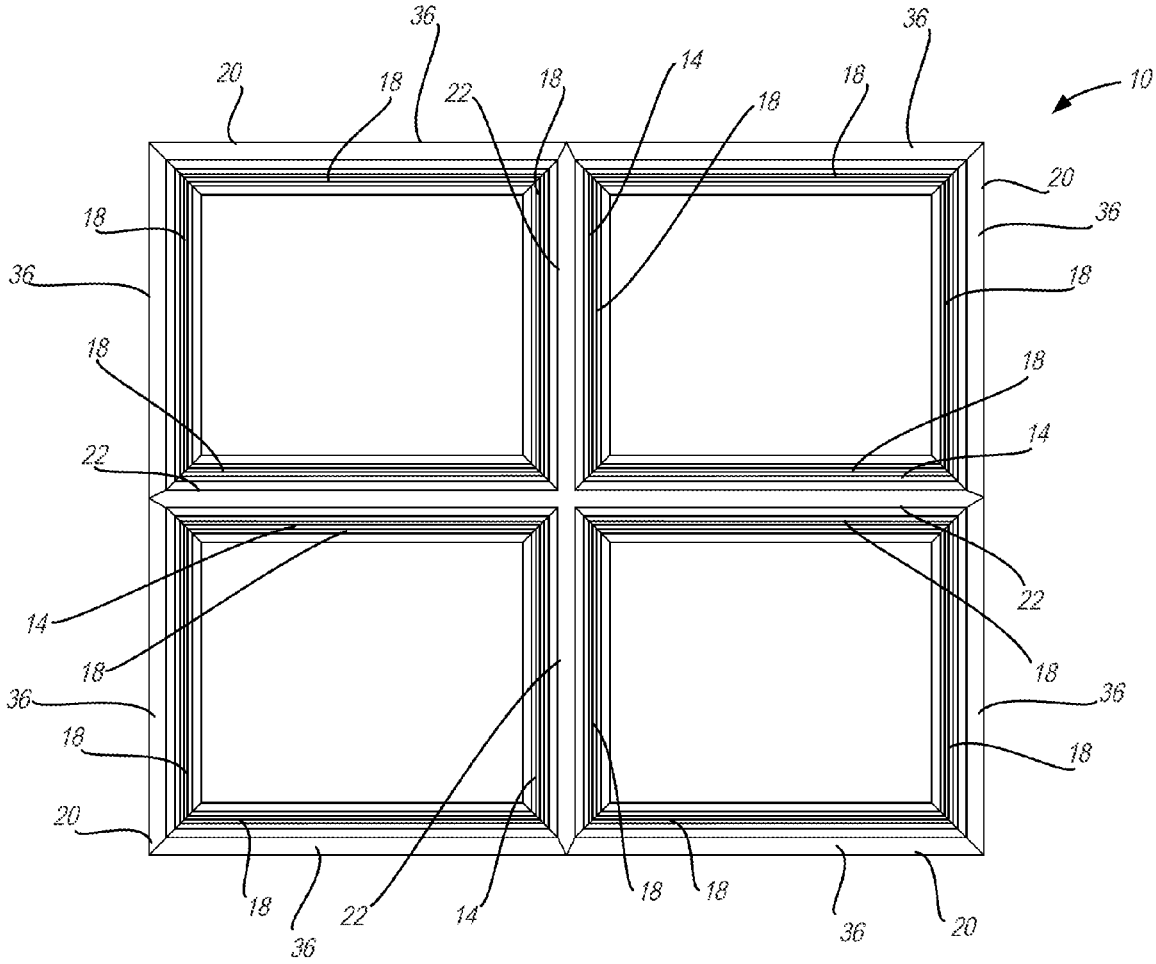

FIG. 1 schematically illustrates an installed four-panel system 10 having a framework of panel retainers (generally indicated in FIGS. 1 and 2 by reference 42). FIGS. 2 and 2*a* schematically show the framework of panel retainers with the modular panels 12 removed. While the frame shown in FIG. 2 may be integrally-formed, it may also be formed from a number of individual panel retainers that are assembled and mounted on the wall to form the frame.

FIGS. 3-9 illustrate different embodiments of panel retainers that may be used to form the desired framework to support modular wall panels 12. The panel retainers shown in these Figures include a groove 18 formed in a base wall 44 of the panel retainer. Although the grooves 18 shown in the Figures include semi-circular cross sections, other shapes are also possible and within the scope of the present invention. The groove 18 may be formed of any shape to mate structure on or associated with the modular panels 12 and thereby retain the panels 12 to the wall. In use, the panel retainers are mounted by their base walls 44 to the wall or other substrate so that the groove(s) are exposed for mating with panels 12. The panel retainers are preferably formed of extruded aluminum, but may alternatively be formed of any material having sufficient strength and rigidity to support the panels.

The panel retainers shown in FIGS. 3-9 have different structures and features depending on their intended placement in the installation.

Figure 3:
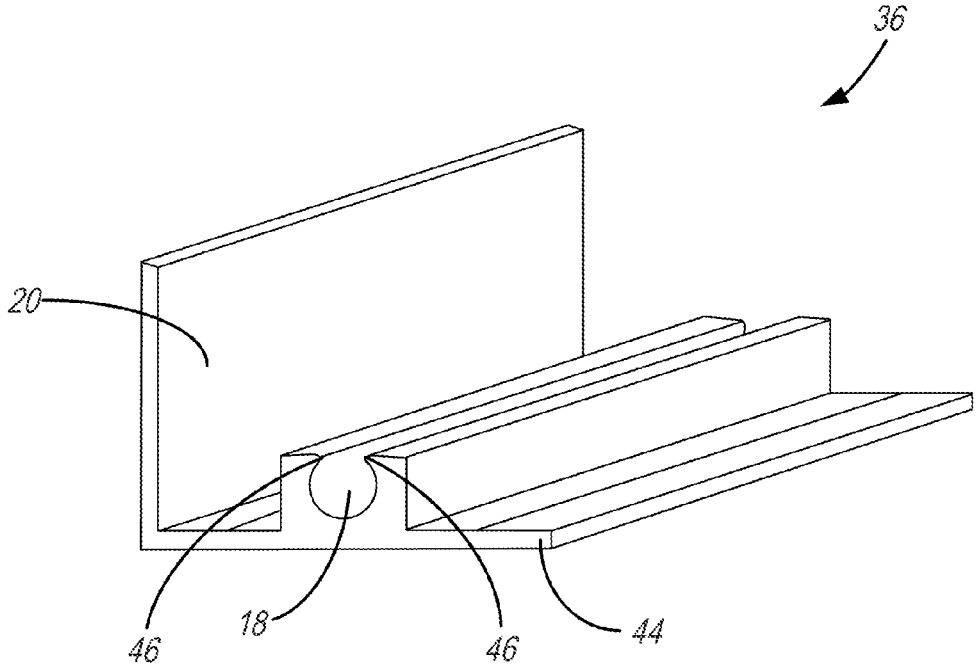
FIG. 3 is a perspective view of one embodiment of a panel retainer for use in a modular panel system.
Figure 3A:
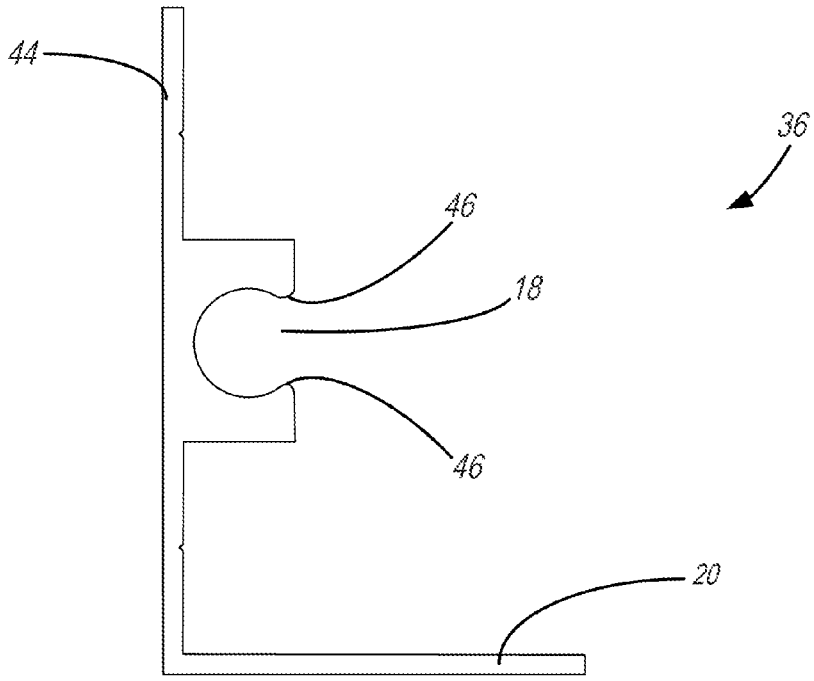
FIG. 3A is a side view of the panel retainer shown in FIG. 3.

For example, the panel retainer 36 shown in FIGS. 3 and 3A includes a single groove 18 and an upstanding edge 20. The panel retainer 36 may be placed around the perimeter of the panel installation so that the edges of the modular panels 12 are shielded from view by the upstanding edge 20. In this way, the edges 20 of the panel retainers 36 may form an aesthetically pleasing frame around the entire installation of panels 12. In other embodiments, it is unnecessary to include an upstanding edge 20 around the panels 12 or otherwise frame them.

Figure 3B:
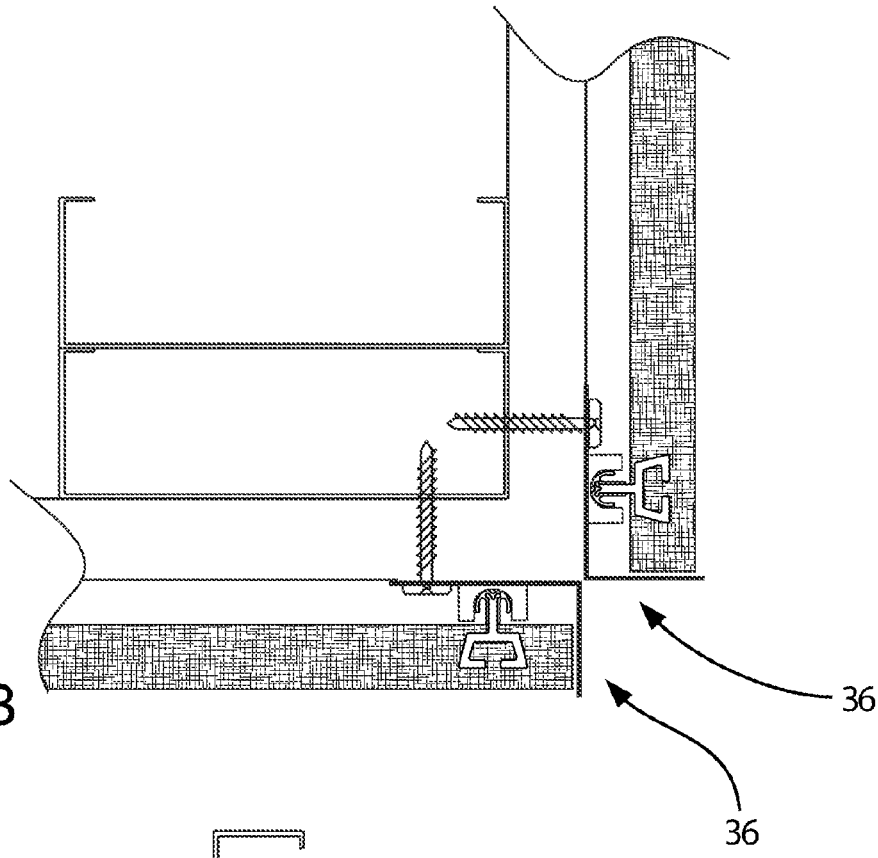
FIG. 3B schematically shows part of a modular panel system that includes the panel retainer shown in FIG. 3.
Figure 3C:
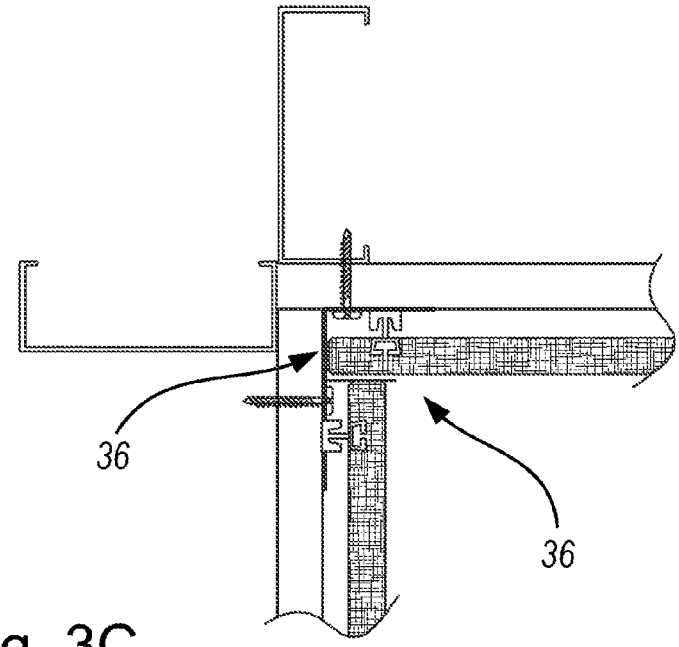
FIG. 3C schematically shows part of a modular panel system that includes the panel retainer shown in FIG. 3, shown installed in a different configuration than FIG. 3B.

As shown in FIGS. 3B and 3C, the panel retainers 36 may be particularly useful when positioning panels 12 at the outside and inside corners of walls.

Figure 4:
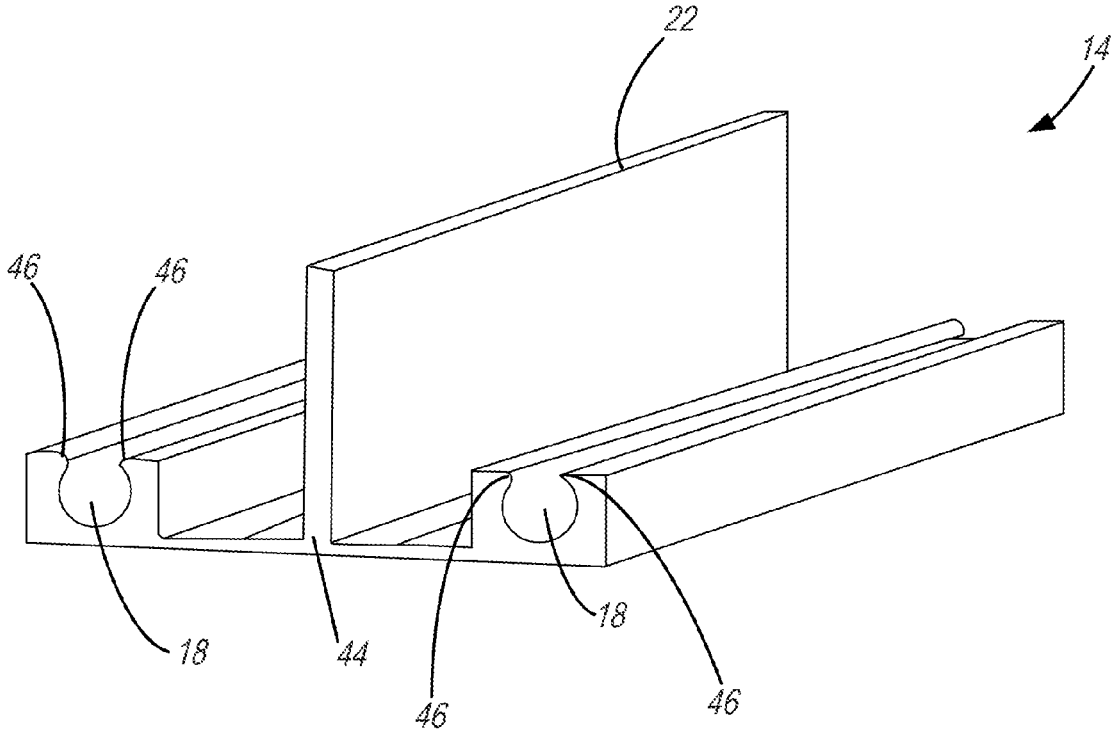
FIG. 4 is a perspective view of another embodiment of a panel retainer for use in a modular panel system.
Figure 4A:
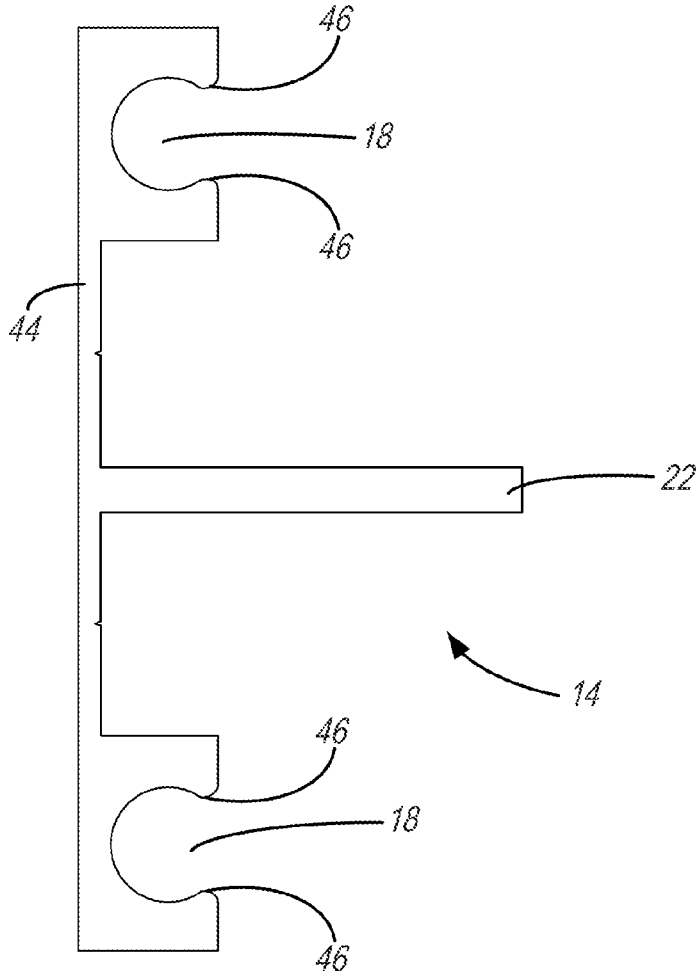
FIG. 4A is a side view of the panel retainer shown in FIG. 4.

FIGS. 4 and 4A show another type of panel retainer 14 useable with the modular panel system 10. The panel retainer 14 shown in these Figures includes two grooves 18 with an upstanding dividing edge 22 in between. Panel retainer 14 may be used to accommodate adjacent panels 12 in the installation. Each groove 18 of the panel retainer 14 can engage a separate panel 12. As shown schematically in FIG. 1, dividing edge 22 may visually frame each wall panel 12. In other embodiments, dividing edge 22 is unnecessary.

Figure 5:
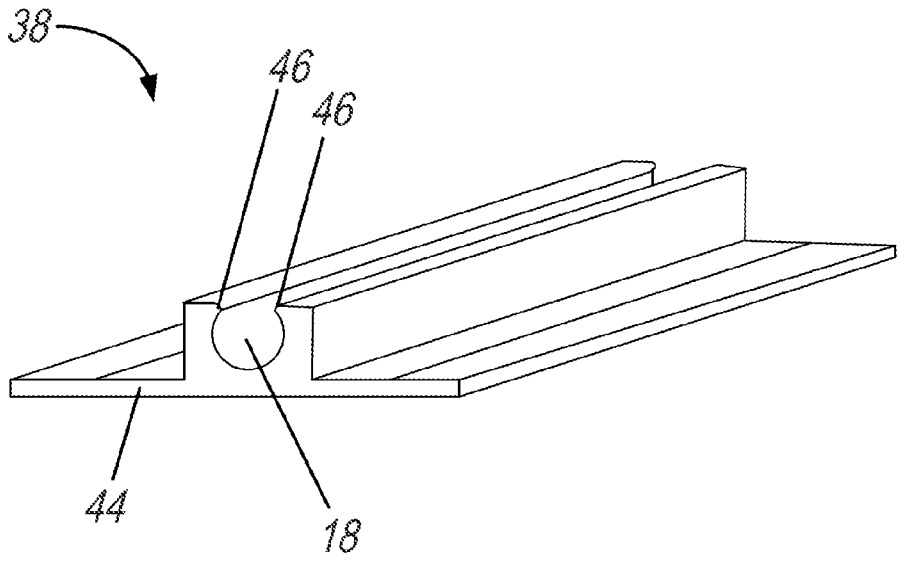
FIG. 5 is a perspective view of yet another embodiment of a panel retainer for use in a modular panel system.
Figure 5A:
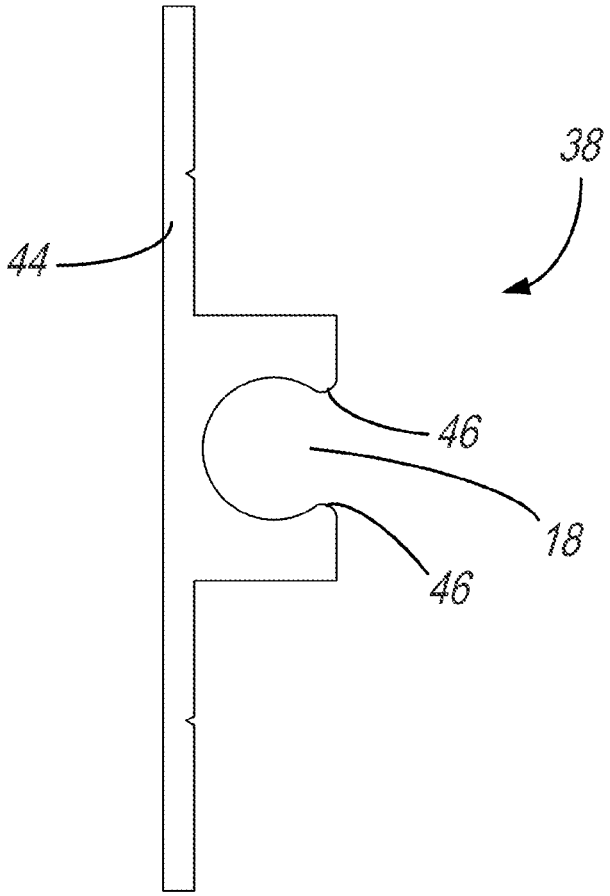
FIG. 5A is a side view of the panel retainer shown in FIG. 5.

FIGS. 5 and 5A show a third type of panel retainer 38 useable in the system 10. The panel retainer 38 shown in these Figures includes a single groove 18 and is used when support of or attachment to the middle of a panel is desired.

The above-described panel retainers 14, 36 and 38, or other types of panel retainers, may be used in a wide variety of numbers and configurations to create an underlying support frame/structure for receiving and supporting the panels 12 in a wide variety of combinations, orientations and configurations. For example, as schematically shown in FIG. 2*a*, panel retainers 14 are used to from the inner t-shaped portion of the panel retainer framework and panel retainers 36 define the perimeter of the framework.

The panel retainers 14, 36 and 38 shown, and/or other types of panel retainers, may be formed in any shape or size. For example, the panel retainers can be formed in any desired width, depth or length. Moreover, the panel retainers used in an installation do not need to be of uniform dimension. For example, in some embodiments, different panel retainers may have different depths such that the modular panels are non-uniform in their spacing from the wall, potentially giving greater prominence to some of the panels than others or creating other effects.

Figure 6:
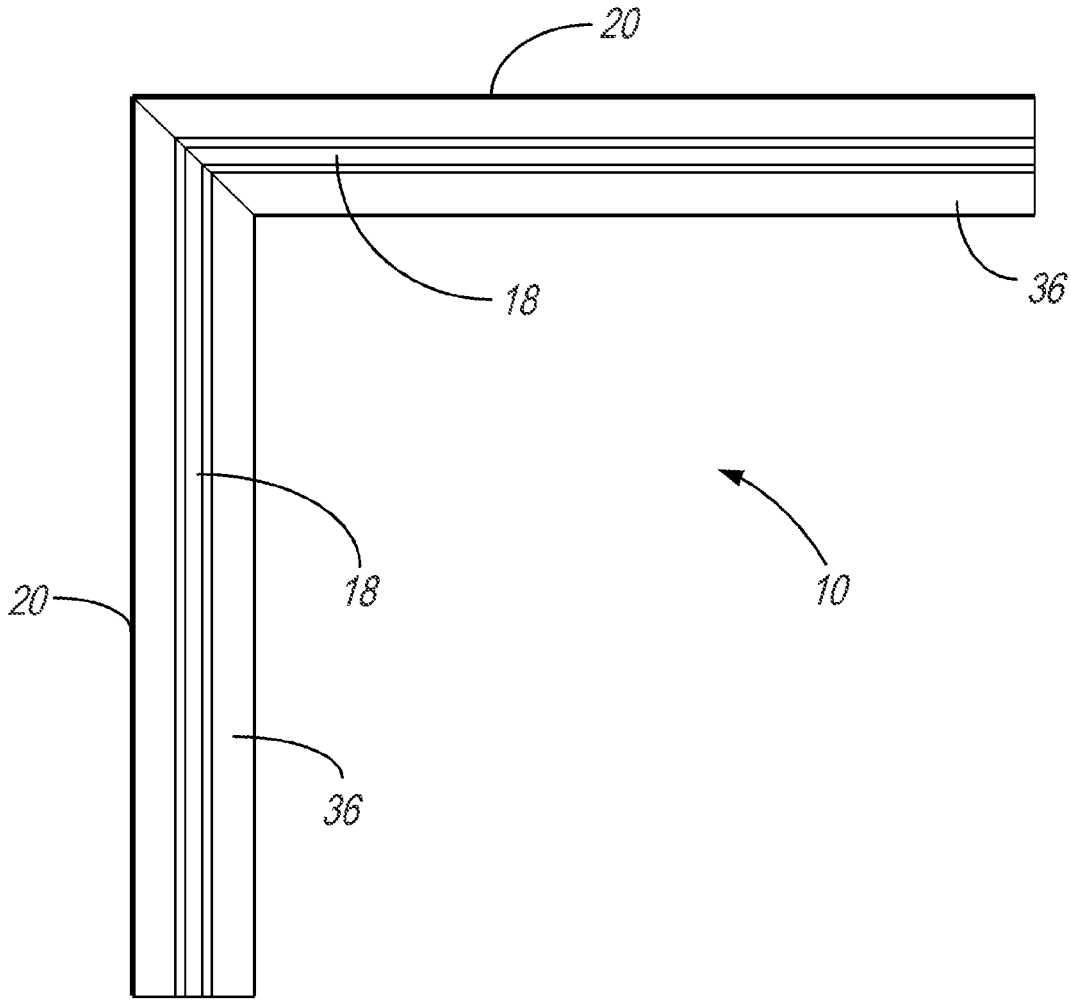
FIG. 6 shows panel retainers, similar to the panel retainer shown in FIG. 3, joined together to form a corner piece.
Figure 7:
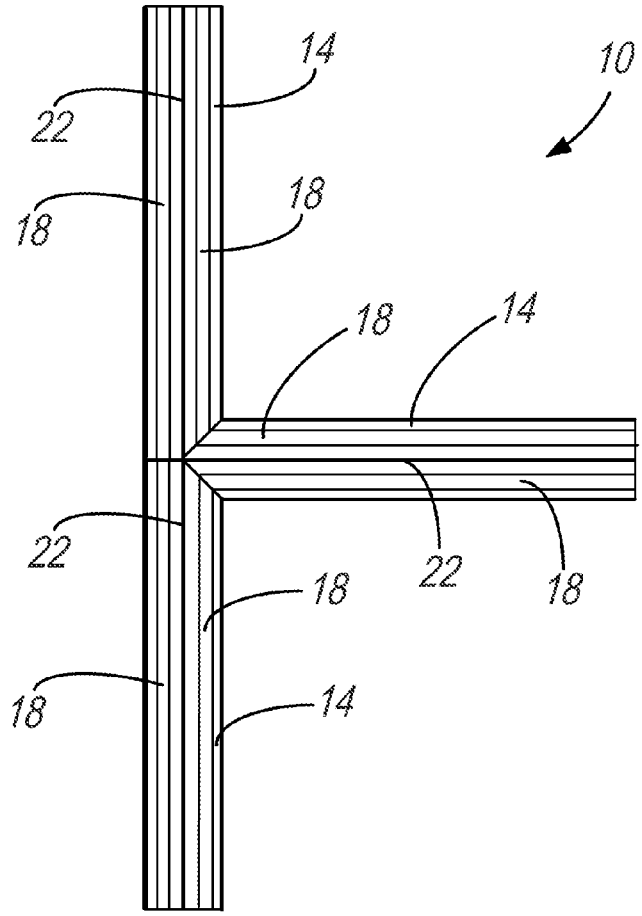
FIG. 7 shows panel retainers, similar to the panel retainer shown in FIG. 4, joined together to form a three-way intersection.
Figure 8:
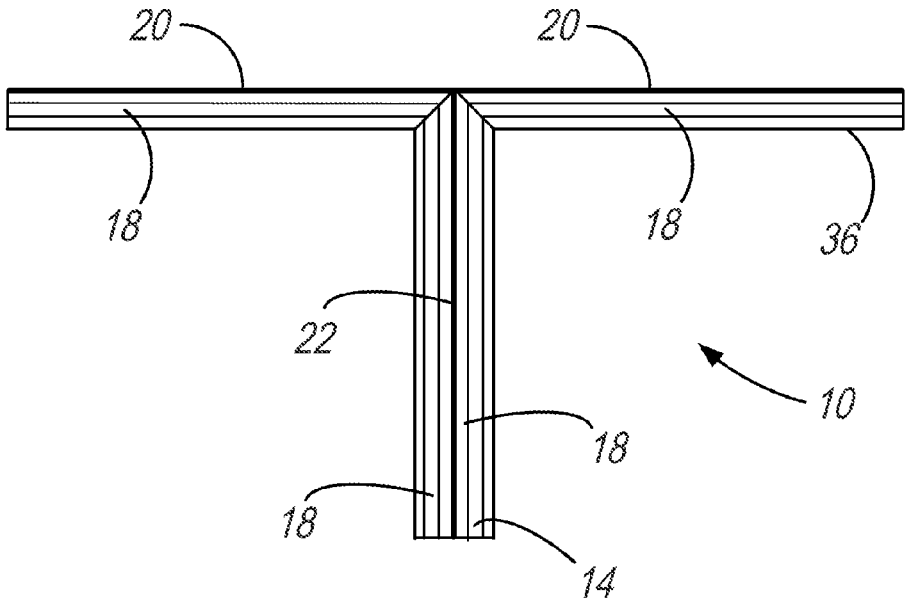
FIG. 8 shows panel retainers, similar to the panel retainers shown in FIGS. 3 and 4, joined together to form a different three-way intersection.
Figure 9:
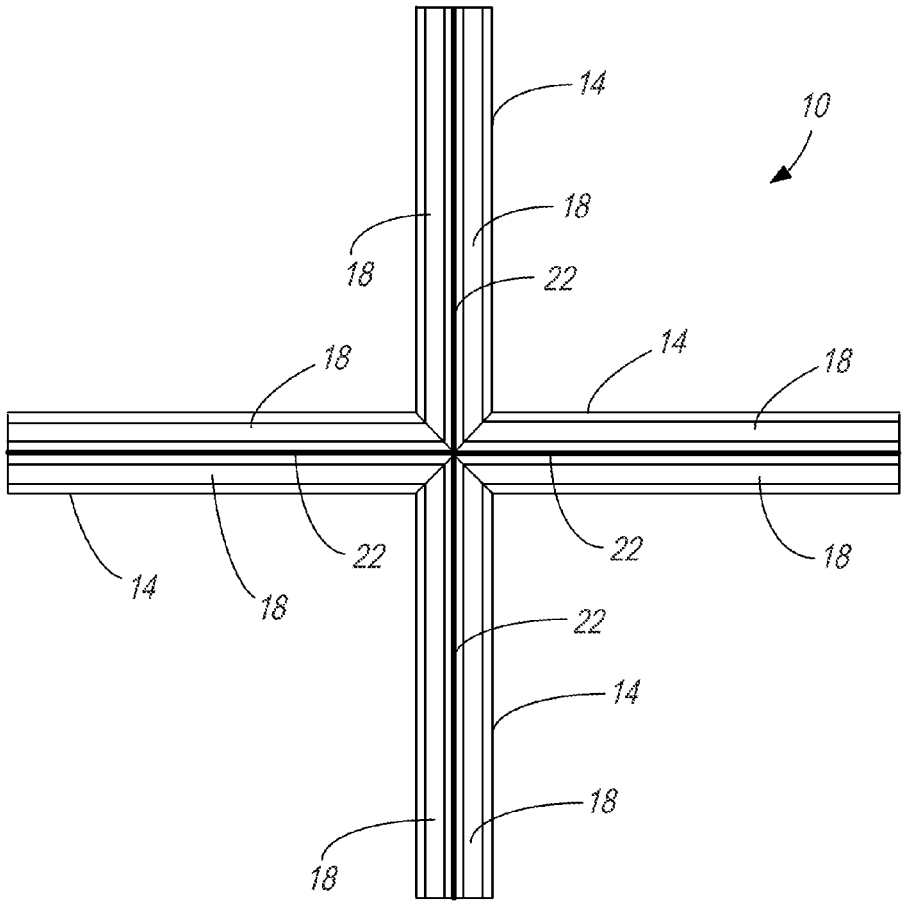
FIG. 9 shows panel retainers, similar to the panel retainer shown in FIG. 4, joined together to form a four-way intersection.

As shown in FIGS. 6-9, panel retainers 14, 36 and 38 may be joined to one another in a wide variety of configurations. FIG. 6 shows two panel retainers 36 with mitered corners such that they are joined together at a right angle. FIG. 7 shows three panel retainers 14 with mitered ends joined to one another. FIG. 8 also shows a three-way intersection, but the configuration of FIG. 8 includes two panel retainers 36 and a panel retainer 14. FIG. 9 shows four panel retainers 14 with mitered portions joined to one another.

Although the Figures generally show panel retainers positioned at 90° or 180° with respect to one another, other orientations are also possible. For example, if modular panels 12 are diamonds, octagons, or other shapes or combination of shapes, it may be necessary or desirable to join or dispose the panel retainers at angles other than 90° or 180° to one another. In still other embodiments, it is unnecessary to miter the ends or other portions of panel retainers 14, 36 and 38.

In some embodiments, some or all of the panel retainers 14, 36 and/or 38 may be physically connected to one another to form a structural unit. Such connections may be welded, snap-fitted, channel locked, bonded or joined by any other mechanical or chemical means for connecting the panel retainers. In other embodiments, panel retainers are not physically connected at the joints. Rather the panel retainers may be connected to the wall as individual units in appropriate locations to define the frame. In other embodiments, the panel retainers may be physically connected to one another after they are connected to the wall. In still other embodiments, it is unnecessary to form joints between the panel retainers and/or the panel retainers do not need to extend the entire length of the side and/or the perimeter of panels 12.

The panel retainers may be installed on a variety of types of surfaces, including, but not limited to, drywall, sheet rock, plaster, concrete or block walls, wooden walls, bare wall joists, etc. The system need not be used only on absolutely planar surfaces. Rather, shimming or other techniques may be used to adapt the system for use on non-planar surfaces as well.

The panel retainers may be secured to the wall using any means sufficient to impart stability to the panel retainers so as to enable them firmly to support the wall covering panels 12. Screws, nails, rivets, adhesives or other mechanical, chemical or other types of fasteners may be used to secure panel retainers 14, 36 and 38 to a wall in a permanent or semi-permanent fashion. In some embodiments, the panel retainers include screw holes to facilitate mounting them to the wall with screws passing through the holes and into the wall.

Once the panel retainers 14, 36 and/or 38 are installed to from the desired framework on the wall or other surface, the modular panels 12, which may be of almost any size and shape, may be mounted to the panel retainers.

Figure 13:
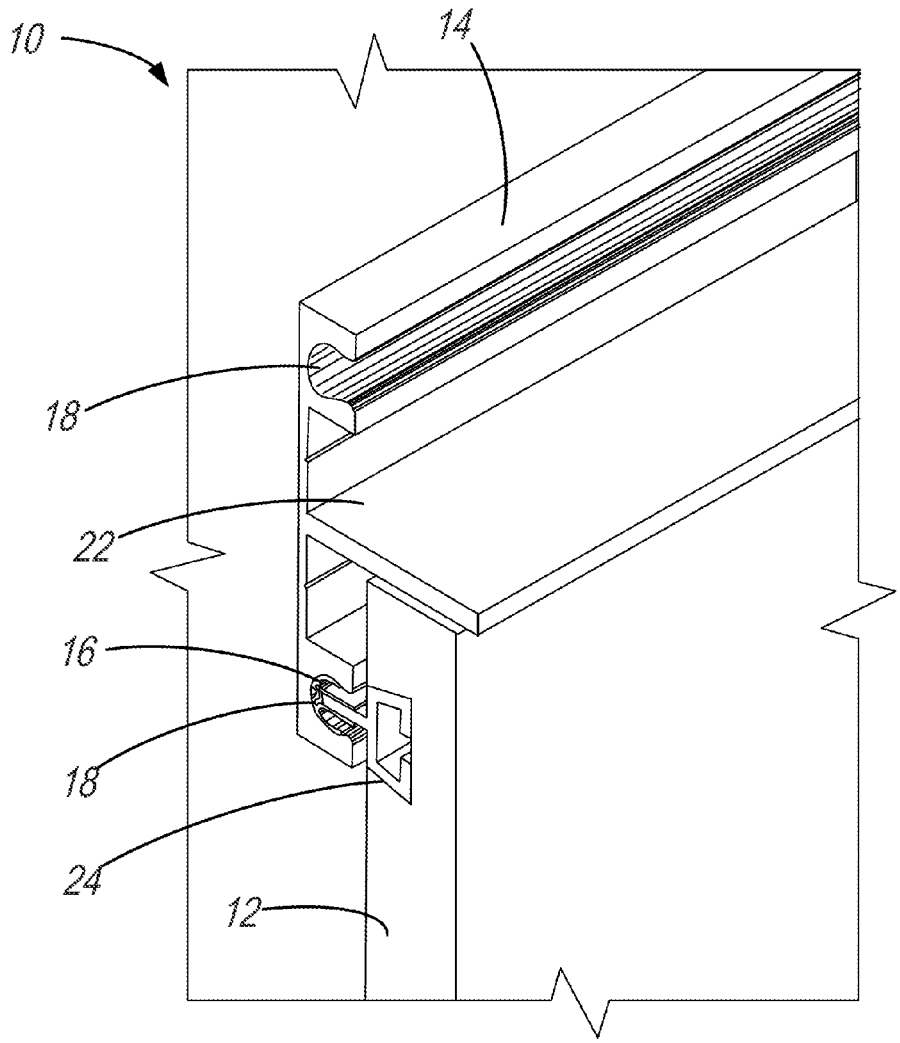
FIG. 13 partially shows a panel secured to a panel retainer by a panel insert in accordance with some embodiments of the present invention.

FIG. 13 shows a modular panel 12 secured to a panel retainer (in this Figure, a panel retainer 14) by the interaction of a deformable body 16 with a groove 18. In the embodiment shown in FIG. 13, the wall panel 12 is associated with a deformable body and the groove 18 is formed in the panel retainer 14. Although only one deformable body 16 for engaging groove 18 is shown in FIG. 13, a plurality of deformable bodies may be used to secure the wall panel 12 to the panel retainer. The deformable body 16 shown in FIG. 13 is part of an insert 24 that is received in a channel 26 formed in the back of modular panel 12. The channel 26 shown in FIG. 13 is dovetail-shaped, however, channels may be different shapes or configurations to receive corresponding shaped and/or configured inserts 24 in sliding or other fashions.

Figure 12:
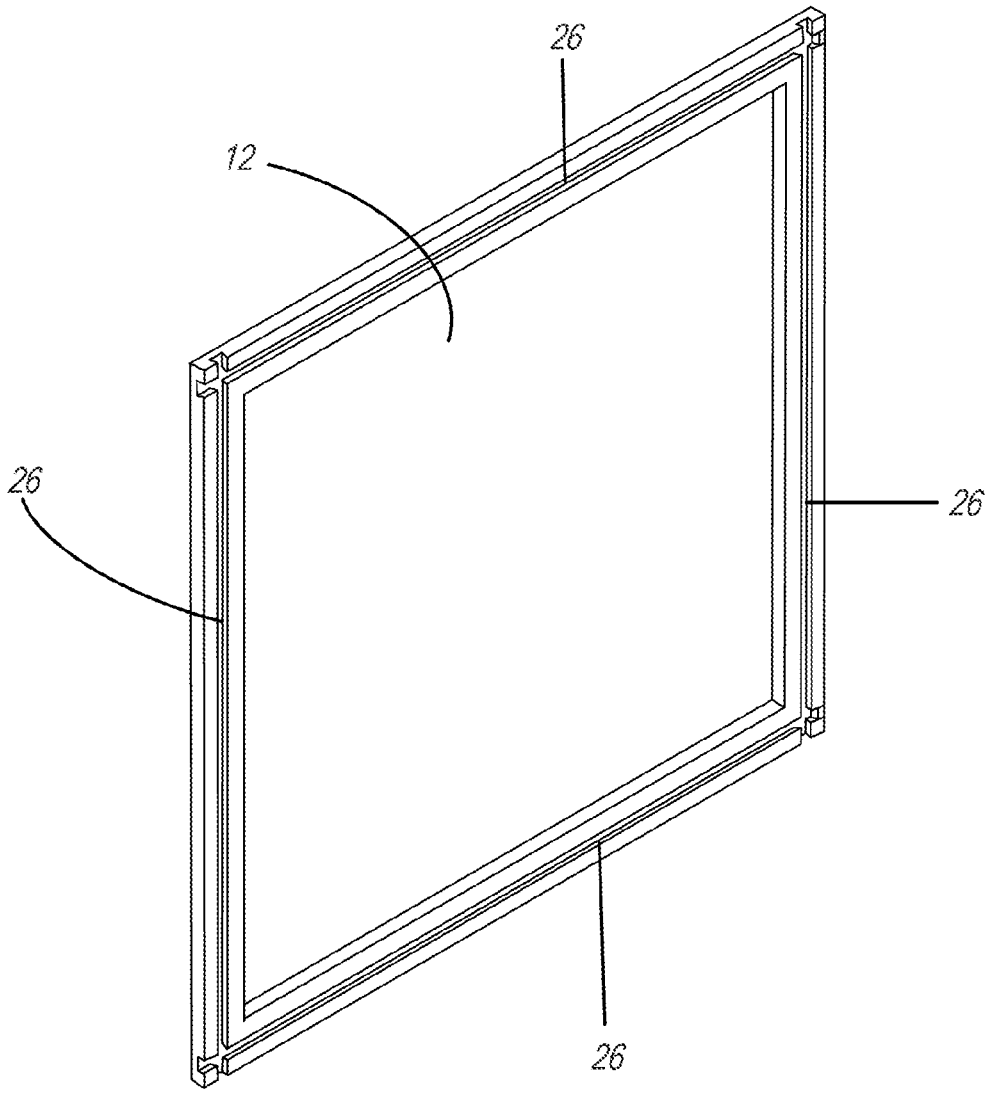
FIG. 12 is a rear view of one embodiment of a panel for use in embodiments of a modular panel system of the present invention.

FIG. 12 shows the channels 26 (each with a channel axis s) formed in the back of modular panel 12. While channels 26 are shown positioned along every edge of the panel 12, they need not be. Rather, any number of channels 26 of any length may be formed on the panels 12 as long as they are positioned so that the panel inserts 24 they receive can be located to mate with the panel retainers installed on the wall. In other embodiments, channels 26 are unnecessary and the panel inserts 24 or other structures may be associated with the panels in other manners. For instance, in some embodiments, portions of the panel inserts 24 may be directly connected to the panel (such as by mechanical or chemical means) or formed integrally therewith.

The panel insert 24 (best seen in FIGS. 10 and 11) includes a base 28, a tongue 30, and a deformable body 16. As shown, the shape of base 28 corresponds to the shape of channel 26 shown in FIG. 12 such that insert 24 may be slid into and retained by channel 26. In other embodiments, base 28 and channel 26 can be shaped or configured in other manners such that channel 26 can receive and secure base 28. In some embodiments, the shape of base 28 need not correspond to the shape of channel 26 and additional means, such as mechanical (screws, nails, etc.) or chemical (adhesives or the like) means can be employed to secure the insert into the groove. In still other embodiments, channels 26 are unnecessary and the insert 24 is simply secured to the back of the panel.

Figure 11:
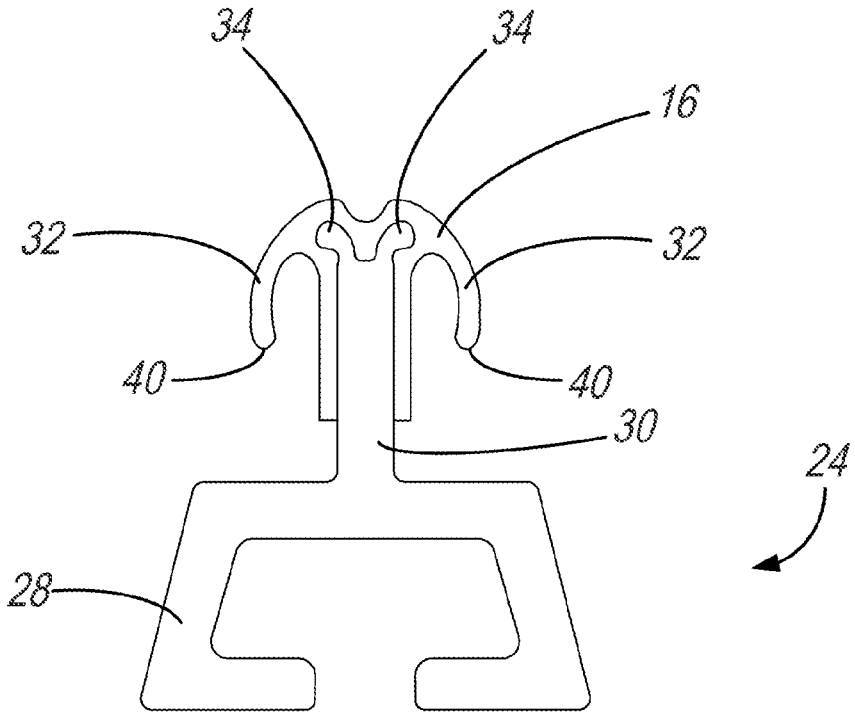
FIG. 11 is a side view of the panel insert of FIG. 10.

FIG. 11 shows that tongue 30 protrudes from the base 28. The base 28 and the tongue 30 are preferably, but do not have to be, formed (and preferably, but not necessarily, integrally formed) of metal and more preferably of extruded aluminum. However, the base 28 and tongue 30 may be formed of any material having sufficient strength and rigidity to withstand the weight of the panels.

Figure 10:
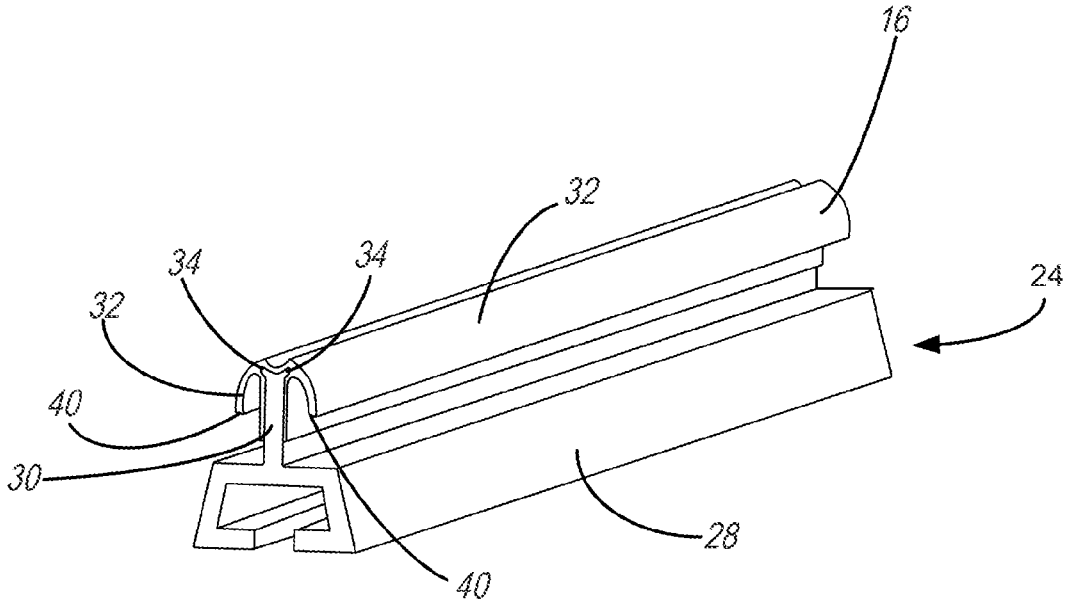
FIG. 10 is a perspective view of one embodiment of a panel insert for use in embodiments of a modular panel system of the present invention.

The deformable body 16 shown in FIGS. 10 and 11 attaches to the exterior of the tongue 30. The deformable body 16 may be a plastic covering (preferably, but not necessarily, polyvinyl chloride) or it may be any other material capable of being deformed to fit into the groove 18 while resistant to removal from the groove 18 after fitting, such that wall panel 12 remains secured to the wall until a sufficient amount of force is applied to remove it.

While the deformable body 16 and panel insert 24 may be co-extruded or formed in other manners, pultrusion technology is preferably used. In such a process, the base 28 and tongue 30 are extruded first, after which the deformable body 16 is extruded onto and bonds with the tongue 30. As shown in FIG. 11, tongue extensions 34 may extend from the end of the tongue 30 distal the base 28, and help retain the deformable body 16 on the tongue 30.

The deformable body 16 shown in FIGS. 10 and 11 has a shape that corresponds to the shape of the grooves 18 formed in the panel retainers, although in other embodiments, the deformable body's shape need not correspond to the shape of the groove 18, but rather can be of any shape capable of mating with groove 18 sufficiently to ensure retention of modular panel 12 in the panel retainer. The deformable body 16 shown has a somewhat rounded shape and includes deformable wings 32, although other shapes, with or without wings 32, are also possible. The deformable wings 32 may compress when the tongue 30 and deformable body 16 are pushed into the groove 18 of panel retainer.

Once deformable wings 32 are within the groove 18 in the panel retainer, the wings 32 may expand somewhat to at least partially resist the removal of deformable body 16 from groove 18. In some embodiments, tips 40 of the deformable wings 32 will interact with the lips 46 of the groove 18 to resist removal of the deformable body. The lips 46 may be inward extending portions of the base 44 that define groove 18, although in other embodiments, lips may be formed in other manners. The deformable body 16 and the groove 18 are preferably dimensioned to result in a snap-fit or press-fit connection.

Once the panel inserts 24 have been installed on the panels 12, the panels may be affixed to the wall by inserting the panel insert tongue 30 with deformable body 16 into the groove 18 of the panel retainer already installed on the wall, as shown in FIG. 13.

The foregoing is provided for the purpose of illustrating, explaining and describing embodiments of the present invention. Further modifications and adaptations to these embodiments will be apparent to those skilled in the art and may be made without departing from the spirit of the invention or the scope of the claims.

The invention claimed is:

1. A modular panel system comprising:

(a) a panel retainer mounted on a substrate, wherein the panel retainer comprises a groove;

(b) a panel comprising at least one channel having a channel axis and extending along a rear surface of the panel; and (c) an insert retained on the panel by the at least one channel and comprising:

(i) a base;

(ii) a metal, substantially rigid tongue extending from the base; and (iii) a polymeric deformable body at least partially surrounding and bonded to an end of the tongue, wherein the base is shaped to be inserted into and to slide along the at least one channel in a direction parallel to the channel axis so that the deformable body extends from the rear surface of the panel and inserts into the groove to secure the panel to the panel retainer.

2. The modular panel system of claim 1, wherein an end of the tongue comprises extensions and wherein the deformable body surrounds the extensions.

3. The modular panel system of claim 1, wherein the deformable body comprises a pair of deformable wings capable of deforming during insertion of the deformable body into the groove of the panel retainer.

4. The modular panel system of claim 3, wherein the deformable wings each comprises a tip and the groove comprise lips and wherein the tip of each deformable wing abuts a lip of the groove when the deformable body is inserted in the groove.

5. The modular panel system of claim 1, wherein the at least one channel comprises a first channel having a first channel axis and a second channel having a second channel axis, wherein the first channel axis and the second channel axis are not parallel.

6. The modular panel system of claim 5, wherein the first channel axis and the second channel axis are substantially orthogonal.

7. The modular panel system of claim 1, wherein the panel retainer comprises at least two grooves.

8. The modular panel system of claim 7, wherein the panel retainer comprises a dividing wall extending between the at least two grooves.

9. The modular panel system of claim 1, wherein the panel retainer comprises an upstanding edge wall.

10. The modular panel system of claim 1, wherein the substrate comprises a wall.

11. The system of claim 1, wherein the base is removable from the channel only in a direction parallel to the channel axis.

12. The system of claim 1, wherein the channel and the base interact via a sliding dovetail.

13. A method of installing a modular panel system comprising:

(a) mounting a panel retainer comprising a groove on a substrate;

(b) providing an insert comprising:

(i) a base;

(ii) a metal, substantially rigid tongue extending from the base; and (iii) a polymeric deformable body at least partially surrounding and bonded to an end of the tongue;

(c) providing a panel comprising a channel having a channel axis and inserting the base of the insert into, and sliding the base along, the channel in a direction parallel to the channel axis so that the insert is retained on the panel by the channel and the deformable body extends from the rear surface of the panel at a first location; and (d) inserting the deformable body into the groove of the panel retainer to secure the panel to the panel retainer.

* * * * *